US007967176B2

(12) United States Patent
Altesellmeier et al.

(10) Patent No.: US 7,967,176 B2
(45) Date of Patent: Jun. 28, 2011

(54) CUTTING AND TRANSPORT CYLINDER IN A WINDING DEVICE FOR WINDING MATERIAL WEBS

(75) Inventors: Thomas Altesellmeier, Lienen (DE); Oliver Koser, Lengerich (DE); Rolf Kammann, Westerkappeln (DE); Werner Decker, Ladbergen (DE)

(73) Assignee: Windmoeller & Hoelscher KG, Lengerich (DE)

( * ) Notice: Subject to any disclaimer, the term of this patent is extended or adjusted under 35 U.S.C. 154(b) by 802 days.

(21) Appl. No.: 10/556,423

(22) PCT Filed: May 6, 2004

(86) PCT No.: PCT/EP2004/004892

§ 371 (c)(1), (2), (4) Date: Nov. 9, 2005

(87) PCT Pub. No.: WO2004/101237

PCT Pub. Date: Nov. 25, 2004

(65) Prior Publication Data

US 2007/0022850 A1 Feb. 1, 2007

(30) Foreign Application Priority Data

May 14, 2003 (DE) ..... 103 21 778

(51) Int. Cl.
*B26D 7/01* (2006.01)
*B65H 20/12* (2006.01)
*B65H 35/08* (2006.01)

(52) U.S. Cl. ..... 226/95; 242/527.1; 242/615.11

(58) Field of Classification Search ..... 242/527.1, 242/615.11, 615.12, 532, 532.2; 226/93, 226/95, 97.1, 97.3; 271/276
See application file for complete search history.

(56) References Cited

U.S. PATENT DOCUMENTS

| | | | | |
|---|---|---|---|---|
| 2,385,692 | A * | 9/1945 | Corbin et. al. | 242/521 |
| 3,019,130 | A * | 1/1962 | Hornbostel | 427/296 |
| 3,741,453 | A * | 6/1973 | Pierce et al. | 226/7 |
| 5,109,741 | A | 5/1992 | Fuchs | |
| 5,329,301 | A * | 7/1994 | Balzeit et al. | 346/134 |
| 5,848,761 | A | 12/1998 | Reinhold | |
| 5,918,518 | A | 7/1999 | Kobayashi et al. | |
| 6,508,429 | B1 | 1/2003 | Madrzak et al. | |
| 6,766,722 | B2 | 7/2004 | Plasswich | |

FOREIGN PATENT DOCUMENTS

| | | |
|---|---|---|
| DE | 40 00 078 A1 | 7/1991 |
| DE | 43 08 710 A1 | 10/1993 |
| DE | 100 47 545 A1 | 5/2002 |
| DE | 100 51 372 A1 | 6/2002 |
| EP | 0 698 571 B1 | 2/1996 |
| EP | 0 802 139 A3 | 10/1997 |

(Continued)

*Primary Examiner* — William E Dondero
(74) *Attorney, Agent, or Firm* — Jacobson Holman PLLC

(57) ABSTRACT

A cutting and transport roller for material webs includes media outlet openings in its peripheral surface to which varying pressure can be applied to control the seating pattern of the material web on the peripheral surface of the roller. The roller has a system of pressure feed lines by which the media outlet openings are connected to means for supplying the media. The roller has at least one pressure reservoir that is a part of the pressure feed line system and that can be connected by a valve to at least one part of the media outlet openings.

11 Claims, 1 Drawing Sheet

FOREIGN PATENT DOCUMENTS

| | | | |
|---|---|---|---|
| EP | 1 035 052 | B1 | 9/2000 |
| GB | 2 146 461 | A | 4/1985 |
| WO | WO 91/05640 | | 5/1991 |
| WO | WO 95/15901 | | 5/1995 |
| WO | WO 00/71332 | A2 | 11/2000 |
| WO | WO 02/070213 | A1 | 9/2002 |

* cited by examiner

CUTTING AND TRANSPORT CYLINDER IN A WINDING DEVICE FOR WINDING MATERIAL WEBS

CROSS-REFERENCE TO RELATED APPLICATION

This is a nationalization of PCT/EP2004/004892 filed 6 May 2004 and published in German.

BACKGROUND OF THE INVENTION

1. Field of Invention

The present invention relates to a cutting and transport roller as well as a process for controlling the seating pattern of a material web on the peripheral surface of the roller.

2. Description of the Prior Art

A cutting and transport roller of this type is known from the patent application EP 0 698 671 A1. The roller described there comprises of an inner hollow space into which a separating body is inserted. This separating body and the outer shell of the roller delimit pressure rooms. The pressure rooms are in contact with the ambient by means of a penetrating borehole in the peripheral surface of the roller. The pressure rooms can be connected to the sources of high pressure and low pressure arranged outside the roller by means of pressure media lines so that, if necessary, a state of high pressure or low pressure is created in the pressure rooms that acts on the material web running on the peripheral surface of the roller. Thus the material web is either laid down (low pressure) to the roller or pushed away (high pressure) from it.

The roller described is generally used in winding devices for winding up material webs. In such a device the material web has to be severed after a complete roll is formed and the start of the new web is placed on a new winding core. Cutters are used for the purpose of cutting the web. These cutters are even integrated into the roller in newer winding devices. One such cutter is described, for instance, in the patent application DE 100 47 545 A1. The cutting elements of these cutters briefly pass through the peripheral surface of the roller and thus cut through the material web. At the same moment low pressure is applied to the pressure rooms so that the material web is held on to the roller. If the start of the web now reaches the new winding core, then high pressure is applied to the pressure rooms. Consequently, the material web is pushed away from the roller and onto the winding core. This process is referred to as the initial winding process.

The cutting and transport roller described in the patent application EP 0698 671 A1 comprises of voluminous hollow spaces in its interior through which the media conveying the pressure—usually air, of course—are supplied to the media outlet openings. Here these media are supplied to the roller by the so-called 'pressure sources,' which can be pumps, for instance.

In practice, it has been seen that the processes of laying down the material web on the roller and/or pushing it away from the roller do not take place reliably at high peripheral speed using the device described.

SUMMARY OF THE INVENTION

Therefore the objective of the present invention is to suggest a cutting and transport roller, with which it is possible to execute the processes of laying down the material web on the roller and/or pushing it away from the roller more reliably even at high peripheral speeds.

This objective is achieved by the characteristics of the invention described herein.

By means of the pressure reservoir, the desired amount of pressure can be applied to the media outlet openings almost instantaneously. In this case, pumps require a lead time for this purpose.

In this connection, it is advantageous if the valve delimiting the pressure reservoir is attached as close as possible to the media outlet openings. This is especially the case if voluminous chambers are provided as pressure lines as in case of the patent application EP 0698 671 A1.

A valve of such type can be designed as a toggle switch, with which it is possible to switch back and forth between the different pressure levels. However, it is also possible to provide several valves that can be operated as single throw-switches. In case of both the embodiments, it is advantageous if high pressure or low pressure is already applied to the valves on one side and if a pressure change occurs at the media outlet openings during operation of the valves in the shortest period of time. In this manner it is possible to control the seating pattern of the material web on the peripheral surface of the roller in terms of time with substantially more precision as compared to the described process known to prior art. It is preferred to use air as the medium for this purpose.

In a third embodiment of the present invention, the cutting and transport roller includes a pressure reservoir arranged in the roller and whose connection to the media outlet openings can be interrupted by at least one valve. The use of two pressure reservoirs, one each for high pressure and low pressure is preferred. This ensures the immediate availability of high or low pressure, whenever required. Furthermore, the advantage of arranging the pressure reservoir inside the roller is that the media supply system does not include any rotary feedthroughs that can result in the loss of media. Thus, the present invention makes it possible to also provide higher pressure.

In a preferred fourth embodiment of the present, invention, the pressure reservoir is designed as a media tank inserted into the roller as a separate component. Designing the roller in this manner reduces the manufacturing costs considerably.

It is advantageous if the walls of the roller and those of the media tank form a line of contact to the maximum extent possible. Here, the media tanks can be designed, for instance, as cylinders.

In a particularly preferred fifth embodiment of the present invention, the roller and the pressure reservoir have independent walls. Thus the media tanks can be arranged in such a manner that their principal inertial axes coincide with the axis of rotation of the roller. Pressure media of varying pressures can then be applied to the pressure media tanks from outside by means of pipelines. This process can also take place at a point of time at which the media are not released from the media reservoir. Here, it does not matter if the media are lost due to the required rotary feedthroughs.

In addition, the present invention includes a process for controlling the seating pattern of a material web on the peripheral surface of a cutting and transport roller. Generally this process is used for the execution of the afore-mentioned initial winding process in a more precise manner in terms of time and thus more reliably particularly at high peripheral speeds as compared to the process that is discussed above and is known from the patent application EP 0698 571 A1. While executing the process according to the present invention, first a static pressure is built up in the components of the pressure supply system by the means for providing media of varying pressure. This pressure is applied to the media outlet openings when the valves are opened.

Thus a pressure is first built up, which is then available directly at the media outlet openings when the valves are opened. In the process according to the present invention, the supply times of the pressure difference are very small and can be ignored by possibly using a control unit.

Here, it is advantageous if the means for providing the media of varying pressure continue to operate even when the valves are opened. Thus the pressure at the media outlet openings can be kept constant even over a longer timeframe.

Moreover, it is particularly advantageous if the means for providing the media of varying pressure continue to operate when the valves are closed till a predetermined amount of pressure is built up.

BRIEF DESCRIPTION OF THE DRAWINGS

A sixth preferred embodiment of this invention is based on the present description and the accompanying drawing of which the single FIGURE illustrates a perspective view of a cutting and transport roller according to the present invention.

DETAILED DESCRIPTION OF THE PREFERRED EMBODIMENTS

Figure 1:
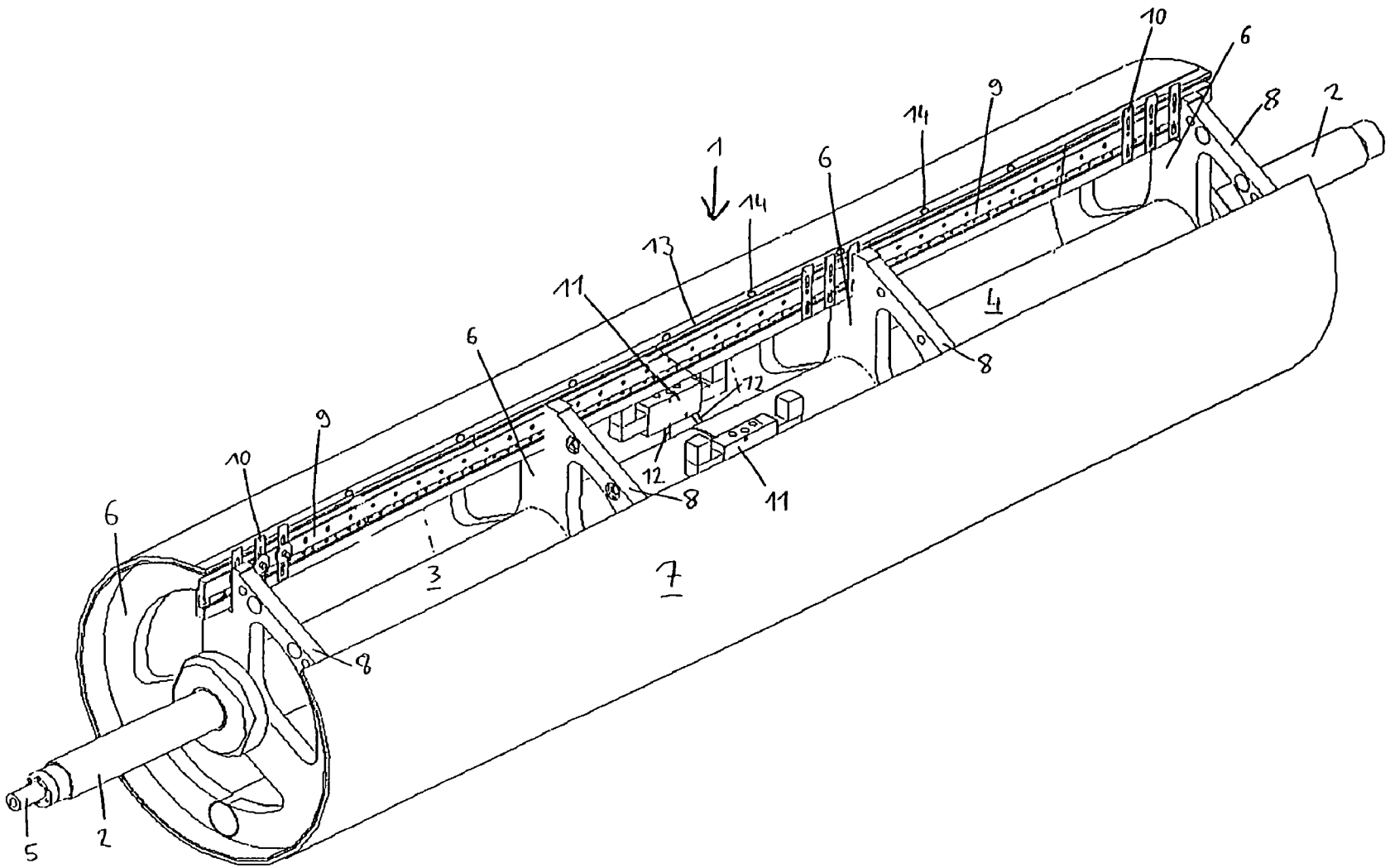

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

FIG. 1 illustrates a cutting- and transport roller 1, whose ends comprise of bearing pins 2. Located between the two bearing pins 2 are two media tanks 3, 4 that together with the bearing pin 2 form the components of the axis of the cutting- and transport roller 1. The bearing pins 2 are penetrated in the axial direction by pipe penetrations 5 by means of which media can be applied to the media tanks 3, 4. On the media tanks 3, 4, circular disk-shaped web plates 6 are fitted that support the outer shell 7 of the roller. The web plates 6 comprise of flat portions 8 on which it is possible to attach a flap opening (not illustrated) for the purpose of maintenance. The web plates 6 support additionally the cutter 9, of which a few cutting knives 10 have been illustrated as examples. The patent application DE 100 47 545 A1 can be referred to for a more detailed description of the cutter.

Below the outer shell 7, two valves 11 are arranged on both sides of the cutter 9. These valves 11 are connected to the two media tanks 3, 4 by means of lines 12. Thus by means of these valves 11, the media from both the media tanks 3, 4 are conveyed further to the media outlet openings 14. An arrangement of valves 11 on both sides of the cutter 9 enables the operation of the cutting- and transport roller in both directions of rotation. As mentioned already, the valves 11 convey the media to the media outlet openings 14 inserted as radial boreholes into the media strips 13, which can be designed as hollow elements.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of Reference Symbols | |
|---|---|
| 1 | Cutting- and transport roller |
| 2 | Bearing pin |
| 3 | Media tank |
| 4 | Media tank |
| 5 | Pipe penetration |
| 6 | Web plate |
| 7 | Outer shell |
| 8 | Flat portion |
| 9 | Cutter |
| 10 | Cutting knives |
| 11 | Valve |
| 12 | Lines |
| 13 | Media strip |
| 14 | Media outlet openings |

What is claimed is:

1. A cutting and transport roller for a material web, comprising:

media outlet openings for media in a peripheral surface of the roller to which a varying pressure is applied to control a seating pattern of the material web on the roller peripheral surface;

a system of pressure feed lines configured to supply the media outlet openings with the media; and separate first and second pressure reservoirs arranged axially end to end and disposed within the roller, each of the pressure reservoirs being (i) a part of the pressure feed line system, (ii) connected by a corresponding valve to at least one part of the media outlet openings, and (iii) arranged such that a principal inertial axis of the first and the second pressure reservoir coincides with an axis of rotation of the roller, with the first pressure reservoir being configured for low pressure media and the second pressure reservoir being configured for high pressure media.

2. The cutting and transport roller pursuant to claim 1, wherein the valve is configured to interrupt the connection between the media outlet openings and the pressure reservoir.

3. The cutting and transport roller pursuant to claim 1, wherein at least one of the first and second pressure reservoirs is configured as a compressed air tank.

4. The cutting and transport roller pursuant to claim 3, wherein walls of the roller and walls of the compressed air tank have a corresponding shape.

5. The cutting and transport roller pursuant to claim 1, wherein walls of the roller and walls of the first and second pressure reservoirs are independent of one another.

6. The cutting and transport roller according to claim 1, wherein the first and second pressure reservoirs have a cylindrical shape.

7. A device for winding up web-shaped material with a cutting and transport roller in accordance with claim 1.

8. A process for controlling a seating pattern of a material web on a peripheral surface of a cutting and transport roller, comprising intermittently supplying via a pressure line system media of varying pressure to media outlet openings in the peripheral surface of the roller so as to selectively lift off or lay down the material web on the peripheral surface, the pressure line system including separate first and second pressure reservoirs arranged axially end to end and disposed within the roller, each of which is connected by a corresponding valve to at least one part of the media outlet openings and is arranged such that a principal inertial axis of the pressure reservoir coincides with an axis of rotation of the roller, with the first pressure reservoir being configured for low pressure media and the second pressure reservoir being configured for high pressure media, the step of supplying the pressure including developing a static pressure in the pressure line system and applying the developed pressure to the media outlet openings by opening of the valves.

9. The process pursuant to claim 8, wherein the media of varying pressure continue to be supplied when the valves are opened.

10. The process pursuant to claim 9, wherein when the valves are closed, the media of varying pressure continue to be supplied until a predetermined amount of pressure is developed.

11. A cutting and transport roller for a material web, comprising:

media outlet openings for media in a peripheral surface of a wall of the roller to which a varying pressure is applied to control a seating pattern of the material web on the roller peripheral surface;

a system of pressure feed lines configured to supply the media outlet openings with the media; and separate first and second pressure reservoirs, with no fluid communication therebetween, arranged axially end to end and disposed within the roller, with a wall of each of the first and second pressure reservoirs being independent of the wall of the roller, and each of the pressure reservoirs being (i) a part of the pressure feed line system, (ii) connected by a corresponding valve to at least one part of the media outlet openings, and (iii) arranged such that a principal inertial axis of the first and the second pressure reservoir coincides with an axis of rotation of the roller, with the first pressure reservoir being configured for low pressure media and the second pressure reservoir being configured for high pressure media such that either of the low pressure media and the high pressure media is available on demand to the media outlet openings.

* * * * *